US007076908B2

(12) United States Patent
Kim

(10) Patent No.: US 7,076,908 B2
(45) Date of Patent: Jul. 18, 2006

(54) ACCESSORY MOUNT FOR A FIREARM

(75) Inventor: Paul Y. Kim, Irvine, CA (US)

(73) Assignee: Surefire, LLC, Fountain Valley, CA (US)

( * ) Notice: Subject to any disclaimer, the term of this patent is extended or adjusted under 35 U.S.C. 154(b) by 3 days.

(21) Appl. No.: 10/889,768

(22) Filed: Jul. 12, 2004

(65) Prior Publication Data

US 2005/0115142 A1 Jun. 2, 2005

Related U.S. Application Data

(60) Provisional application No. 60/520,106, filed on Nov. 13, 2003.

(51) Int. Cl.
*F41G 1/00* (2006.01)

(52) U.S. Cl. ..... 42/146; 42/115; 42/117; 42/148

(58) Field of Classification Search ..... 42/146, 42/114, 115, 117, 148
See application file for complete search history.

(56) References Cited

U.S. PATENT DOCUMENTS

| | | | | |
|---|---|---|---|---|
| 1,338,239 | A | 4/1920 | Matys | |
| 2,450,584 | A | 10/1948 | Dodge | |
| 3,584,533 | A | 6/1971 | Allyn | |
| 3,901,125 | A | 8/1975 | Raville | |
| 4,313,272 | A | 2/1982 | Matthews | |
| 4,344,246 | A | 8/1982 | Bauman et al. | |
| 4,418,487 | A * | 12/1983 | Strahan | 42/125 |
| 4,542,447 | A | 9/1985 | Quakenbush | |
| 4,777,754 | A | 10/1988 | Reynolds, Jr. | |
| 4,856,218 | A | 8/1989 | Reynolds, Jr. | |
| 5,107,612 | A | 4/1992 | Bechtel | |
| 5,208,826 | A | 5/1993 | Kelly | |
| 5,299,375 | A | 4/1994 | Thummel et al. | |
| 5,323,555 | A | 6/1994 | Jehn | |
| 5,388,364 | A * | 2/1995 | Paldino | 42/117 |
| 5,430,967 | A | 7/1995 | Woodman, III et al. | |
| 5,457,901 | A | 10/1995 | Gernstein et al. | |
| 5,471,777 | A | 12/1995 | McDonald | |
| 5,522,167 | A | 6/1996 | Teetzel | |
| 5,581,898 | A | 12/1996 | Thummel | |
| 5,584,137 | A | 12/1996 | Teetzel | |
| 5,621,999 | A | 4/1997 | Moore | |
| 5,628,555 | A | 5/1997 | Sharrah et al. | |
| 5,654,594 | A | 8/1997 | Bjornsen, III et al. | |
| 5,669,174 | A | 9/1997 | Teetzel | |
| 5,758,448 | A | 6/1998 | Thummel | |
| 5,768,819 | A | 6/1998 | Neal | |
| 5,816,683 | A | 10/1998 | Christiansen | |
| 5,930,935 | A * | 8/1999 | Griffin | 42/105 |
| 6,023,875 | A | 2/2000 | Fell et al. | |
| 6,378,237 | B1 | 4/2002 | Matthews et al. | |
| 6,591,536 | B1 * | 7/2003 | Houde-Walter et al. | 42/114 |

* cited by examiner

*Primary Examiner*—Michael J. Carone
*Assistant Examiner*—Bret Hayes
(74) *Attorney, Agent, or Firm*—David Weiss

(57) ABSTRACT

An accessory mount having a rail for removably mounting an accessory (such as a light beam generator) to a firearm, the accessory mount being removably secured to the firearm through utilization of an improved slide stop and pin combination, and positionally stabilized by utilization of a shock absorbing trigger guard bumper.

25 Claims, 2 Drawing Sheets

ACCESSORY MOUNT FOR A FIREARM

CROSS REFERENCE TO RELATED APPLICATION

This application claims the benefit of U.S. Provisional Application No. 60/520,106, filed Nov. 13, 2003, which application is incorporated herein by reference.

BACKGROUND OF THE INVENTION

This invention relates to accessory mounts for mounting an accessory to a firearm, and more particularly to a mount or interface adapter for securing a light beam generator apparatus to a firearm including a handgun.

Light beam generator apparatus, such as flashlights and laser aiming devices, have long been adapted for being secured to firearms as target illuminators and laser sights. For example, U.S. Pat. No. 4,777,754, issued to Edward C. Reynolds, Jr. and assigned to the assignee of the present invention, teaches a light beam generator assembly mounted to a firearm below the firearm's barrel and forwardly of the firearm's trigger guard. As applied to a handgun having a longitudinally moveable slide and a slide stop which causes the slide to lock open automatically after the last round has been fired and ejected, or which may be manually actuated at other times, the Reynolds light beam generating apparatus is pivotably secured to the handgun's slide stop pin transversely secured to the handgun frame. Positional stabilization of the secured light beam generator device on the handgun is facilitated by an adjustable set screw extending from the rear of the light beam generator housing and abutting the front surface of the handgun's trigger guard. Reynolds U.S. Pat. No. 4,777,754 is incorporated herein by reference.

U.S. Pat. No. 6,378,237, issued to John W. Matthews and Paul Y. Kim and assigned to the assignee of the present invention, discloses an accessory mount or interface adapter clamped to the front of the handgun's trigger guard and longitudinally extending beneath the handgun's barrel. The accessory mount includes a rail having a pair of longitudinal grooves, one along each side of the rail, and the light beam generator apparatus includes a pair of longitudinal tongues for slidably mating with the mount's longitudinal grooves for being slidably held along the rail. A latch on the light beam generator housing co-acts with a transverse slot in the rail to releasably prevent further longitudinal movement of the light beam generator apparatus when such apparatus is at a predetermined position along the rail. Matthews et al. U.S. Pat. No. 6,378,237 is incorporated herein by reference.

SUMMARY OF THE INVENTION

By the present invention, there is provided an accessory mount or interface adapter having a rail for mounting a rail mountable accessory (in particular a light beam generator apparatus) to a firearm, which rail mount is removably secured to the firearm through utilization of an improved slide stop and pin combination, and which rail mount is positionally stabilized by utilization of a shock absorbing trigger guard bumper.

According to a preferred embodiment of the present invention, there is provided an accessory mount for mounting an accessory device to a firearm, the firearm including a longitudinal barrel, a frame having a transverse bore and a trigger guard, the accessory device comprising the combination of: a longitudinal rail adapted for removably securing the accessory device thereto; structural members upwardly projecting from the respective sides of the rail and adapted to straddle the frame with the rail beneath the barrel and forwardly of the trigger guard, the structural members including respective bores situated for being transversely aligned with the bore in the frame when the accessory mount is applied to the frame; a pin configured for being received by the bores in the longitudinal members and the bore in the frame when the accessory mount is applied to the firearm; an appendage downwardly projecting from the rail in the vicinity of the rear end of the rail; and a rearwardly biased bumper carried by the appendage for being rearwardly urged against the trigger guard when the accessory mount is applied to the firearm with the pin received by the bores in the structural members and the bore in the frame.

The preferred embodiment of the present invention is of particular application with a handgun including a slide and a slide stop, wherein the pin is secured to the slide stop for pivotally securing the slide stop to the frame of the firearm. The slide stop is preferably pivotable about the pin, such as by being rotatably secured to the pin.

In the accessory mount of the preferred embodiment, the appendage includes a front wall depending from the rail, and the rearwardly biased bumper includes a bumper (preferably resilient) and a spring secured between the bumper and the front wall. Lateral walls may rearwardly extend from the front wall, for straddling a front portion of the trigger guard when the accessory mount is applied to the firearm. A spacer (such as a resilient pad) may be carried by the rail for engaging a lower surface of the frame of the firearm.

According to an aspect of the present invention, firearm and accessory mount apparatus comprises in combination: a firearm including a longitudinal barrel, a frame having a transverse bore, a slide movable along the frame, and a trigger guard; a longitudinal rail adapted for removably securing an accessory device thereto; structural members upwardly projecting from the respective sides of the rail and straddling the frame with the rail beneath the barrel and forwardly of the trigger guard, the structural members including respective bores transversely aligned with the bore in the frame; a pin received by the bores in the structural members and the bore in the frame; a slide stop secured to the pin; an appendage downwardly projecting from the rail in the vicinity of the rear end of the rail; and a rearwardly biased bumper carried by the appendage and rearwardly urged against the trigger guard. The slide stop is preferably pivotally secured about the pin, and the appendage preferably includes a front wall depending from the rail, with a spring securing the preferably resilient bumper to the front wall. The appendage may include lateral walls rearwardly extending from the front wall and straddling a front portion of the trigger guard, as well as a spacer on the rail engaging a lower surface of the frame.

According to another aspect of the present invention, there is provided firearm apparatus comprising in combination: a firearm including a longitudinal barrel, a frame having a transverse bore, and a slide movable along the frame; a pin received by the bore in the frame; and a slide stop pivotally secured to (preferably rotatable about) the pin.

In accordance with a further aspect of the present invention, there is provided apparatus for a firearm including a longitudinal barrel, a frame having a transverse bore, and a slide longitudinally movable along the frame, such apparatus comprising: a pin adapted to be received by the transverse bore; and a slide stop pivotally secured to the pin, such as the slide stop being rotatable about the pin.

BRIEF DESCRIPTION OF THE DRAWINGS

The novel features believed to be characteristic of the invention, together with further advantages thereof, will be better understood from the following description considered in connection with the accompanying drawings in which a preferred embodiment of the present invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
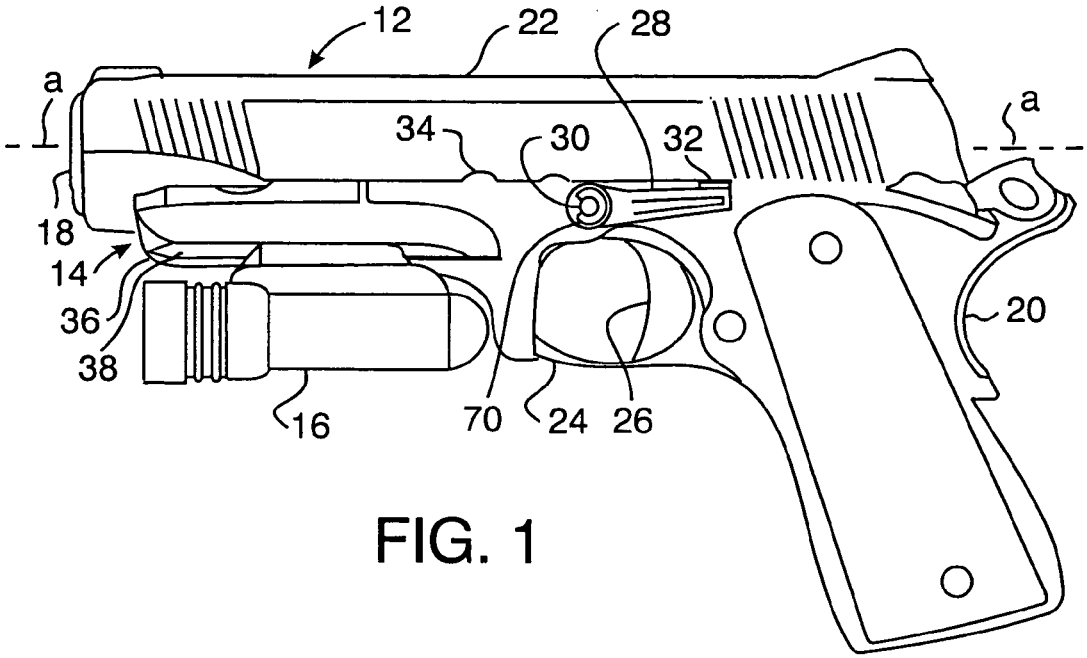
FIG. 1 is a side elevation view of a firearm with a light beam generator apparatus mounted to a preferred embodiment of an accessory mount or interface adapter according to the present invention, the accessory mount being secured to the firearm.
Figure 2:
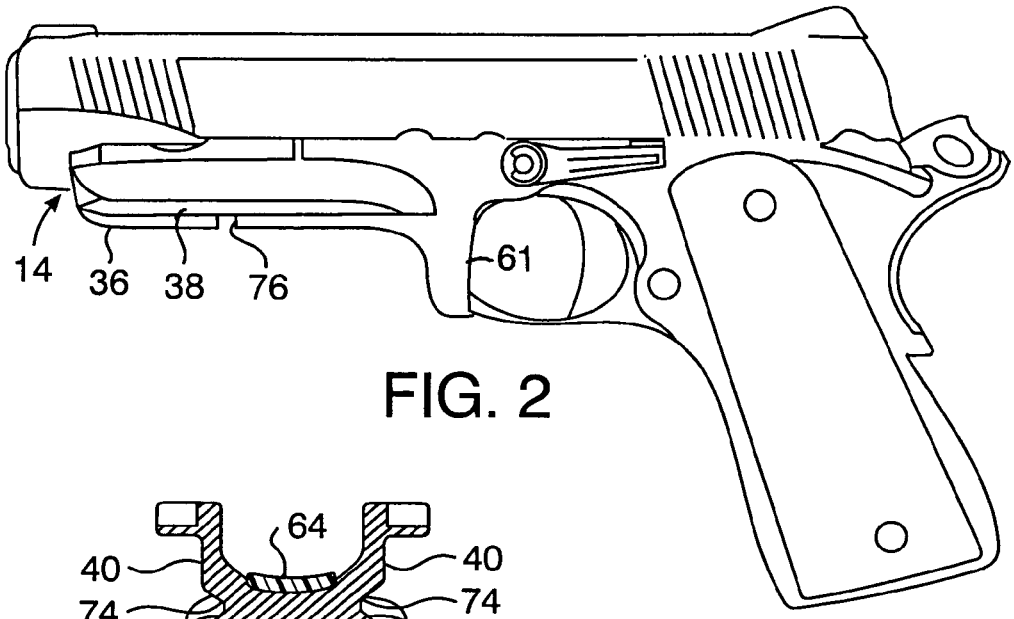
FIG. 2 is similar to FIG. 1, except that the light beam generator apparatus has been removed therefrom.

Turning to the drawings, there is illustrated in FIGS. 1 and 2 an example of a firearm 12, specifically a .45 caliber Model 1911 handgun, to which a preferred embodiment of an accessory mount or interface adapter 14 according to the present invention has been secured, FIG. 1 also showing a light beam generator apparatus or light module 16 mounted to the accessory mount 14. The firearm 12 includes a barrel 18 extending along a longitudinal axis a from the handgun's frame 20, and includes a slide 22 which houses the handgun's firing pin, firing pin block and extractor, and which cocks the hammer during recoil. The handgun 12 includes a trigger guard 24 in front of the handgun's trigger 26.

As used herein, the word "longitudinal" describes a direction parallel to the axis a; "transverse" describes a horizontal direction perpendicular to the axis a when the barrel 18 is horizontally positioned; "above" means vertically above when the handgun 12 is held with its barrel 18 horizontal; "below" or "beneath" means vertically below when the handgun 12 is held with the barrel 18 horizontal; "front" or "forward" describes the direction toward the muzzle of the barrel 18 (i.e., to the left as shown in FIGS. 1–3, 6, 7 and 10); and "rear" or "rearward" describes the direction opposite the front or forward direction (i.e., to the right as shown in the drawing of FIGS. 1–3, 6, 7, 9 and 10).

Figure 12:
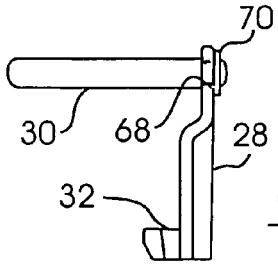
FIG. 12 is a plan view of a preferred embodiment of a modified slide stop and pin combination according to the present invention, for securing the accessory mount to the handgun.

As is well known in handguns of this type, upon firing of the handgun the slide moves rearwardly with respect to the frame, extracting the fired cartridge case for ejection by the ejector, cocks the hammer and compresses the recoil spring, after which the slide moves forwardly feeding the next cartridge into the chamber and locking the breech. After the last round has been fired and ejected, a slide stop 28 is rotatably urged by the magazine follower to pivot about the axis of a transverse pin 30 supported by the frame 20, such that a projection 32—slidably retained along a longitudinal edge of the slide 22—of the slide stop 28 (see also FIG. 12) is upwardly urged to engage a recess 34 along such edge of the slide 22, for releasably stopping and holding the slide 22 in its rearward or open position.

The accessory mount 14 includes a longitudinal rail 36 (parallel to longitudinal axis a' which is beneath and parallel to the axis a when the accessory mount 14 is installed on the handgun 12) having two longitudinal grooves 38, one along each side of the rail 36. Two structural members or uprights 40 upwardly project from the rail 36 and longitudinally extend along the respective sides of the rail 36. Two transversely aligned bores 42 extend through the uprights 40 in the vicinity of the rear ends 44 of the structural members 40. An appendage 46 projects downwardly from the rail 36, and is preferably positioned toward the rear of the rail 36 and forwardly of the transverse bores 42.

The accessory mount 14 is dimensioned such that it may be placed to the handgun 12 with the structural members 40 straddling the handgun's frame 20 beneath the barrel 18, and with the appendage 46 just forward of the trigger guard 24 when the structural members' rear bores 42 are transversely aligned with a transverse bore 48 (FIG. 10) in the frame 20 through which the handgun's slide stop pin 30 extends. The accessory mount 14 is thereby pivotally secured to the handgun frame 20 about the transverse axis t of the installed slide stop pin 30.

The appendage 46 houses a rearwardly biased bumper 50 that is rearwardly urged against the trigger guard 24 when the accessory mount 14 is installed on the handgun 12. In its preferred embodiment, the appendage 46 is generally U-shaped in cross-section, and includes a vertical front wall 52 depending from the rail 36 and having a rearwardly extending post 54 surrounded by an annular groove 56, to which is secured the forward end of a helical spring 58. The bumper 50 is secured to the rearward end of the spring 58, such as by fitting the rearward end of the spring 58 into a front-opening annular cavity in the bumper 50. The spring 58 urges the rearward surface 62 of the bumper 50 against the trigger guard 24 when the accessory mount 14 is installed on the handgun 12 as described herein, providing a shock absorbing function between the accessory mount 14 (and the mounted light module 16) and the trigger guard 24 when the handgun 12 is fired. The bumper 50 is preferably of a resilient material such as neoprene.

Figure 5:
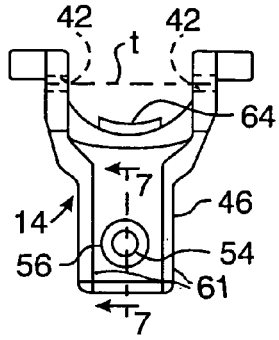
FIG. 5 is rear elevation view of the accessory mount shown in FIG. 3.
Figure 6:
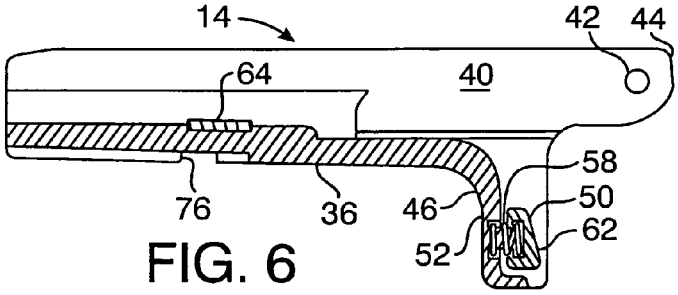
FIG. 6 is a cross-sectional view of the accessory mount of FIG. 3 but including the rear spring and trigger guard bumper, taken along the line 6—6 of FIG. 3 and viewed in the direction of the appended arrows.
Figure 7:
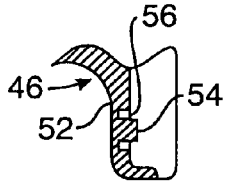
FIG. 7 is a cross-sectional view of a fragment of the accessory mount of FIG. 3, taken along the line 7—7 of FIG. 5 and viewed in the direction of the appended arrows.
Figure 10:
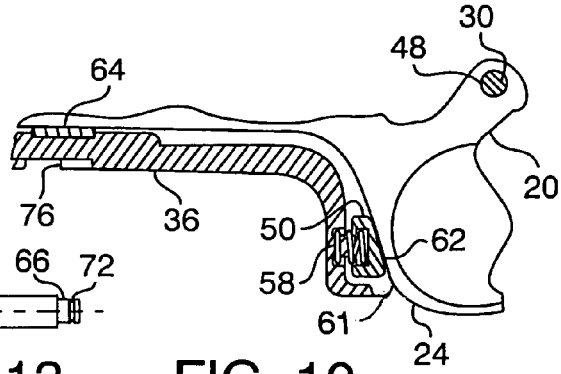
FIG. 10 is a fragmentary cross-sectional view of the accessory mount as in FIG. 6, shown installed on the frame of the handgun.

The appendage 46 may include lateral walls 61 rearwardly extending from the front wall 52, for straddling a front portion of the trigger guard 24 as shown in FIGS. 2, 5 and 10.

A spacer 64, for example a pad of preferably resilient material such as neoprene, may be secured to the upper surface of the rail 36 for engaging the lower surface of the handgun frame 20, for spacing such frame surface from the upper surface of the rail 36 and for providing a cushion therebetween.

When securing the accessory mount 14 to the handgun 12, the slide stop pin originally supplied with the handgun 12 may be removed from the frame bore 48. The accessory mount 14 is then placed to the handgun 12 with the bores 42 of uprights 40 aligned with the frame transverse bore 48, with the rail 36 longitudinally extending beneath the barrel 18 and with the accessory mount 14 rearwardly manipulated for rearwardly urging the biased bumper 62 against the trigger guard 24, whereupon the slide stop pin is inserted through the transverse bores 42 and 48.

Figure 11:
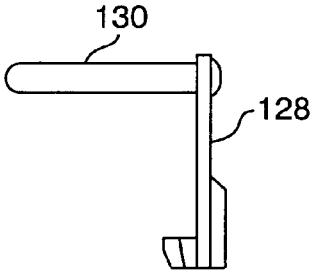
FIG. 11 (PRIOR ART)
FIG. 11 is a plan view of a prior art slide stop and pin combination for securing the accessory mount of the present invention to the handgun.
Figure 8:
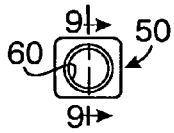
FIG. 8 is a front elevation view of the trigger guard bumper included in the accessory mount shown in FIG. 6.
Figure 9:
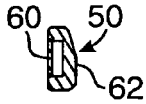
FIG. 9 is a cross-sectional view of the trigger guard bumper of FIG. 8, taken along the line 9—9 of FIG. 8 and viewed in the direction of the appended arrows.
Figure 13:
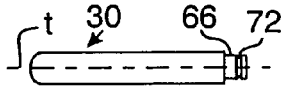
FIG. 13 is a plan view of the pin shown in FIG. 12.

The accessory mount 14 of the present invention is preferably utilized in combination with a slide stop and pin combination where the slide stop projection 32 is slidably retained along the edge of the slide 22. One prior art slide stop and pin combination is shown in FIG. 11, wherein the pin 130 is fixedly secured (such as by welding) to the slide stop 128. Although such welded slide stop and pin combinations may be utilized with the accessory mount 14 of the present invention, it is preferred that the slide stop and pin combination of FIGS. 12 and 13 be utilized in which the slide stop 28 is rotatably secured to the pin 30. For example, one end of the slide stop pin 30 may include a neck portion 66 inserted within a bore 68 through the slide stop 28 and held by a retaining ring 70 cooperating with a further neck portion 72 of the pin 30., It has been found that the resulting pivotal securement of the slide stop 28 about the pin 30 facilitates installation of the accessory mount 14 to the handgun 12, by permitting free rotation of the slide stop 28 and consequent ease of positioning of the projection 32 to the slide 22 notwithstanding that the pin 30 may be forced against and held immobile by the surfaces of the bores 42 and/or 48.

The accessory mount body of the present invention may be made using fabrication methods well known in the art, of well-known materials typically used in the art of making firearm accessory mounts including rigid and durable materials such as polymeric materials as well as lightweight aluminum alloys.

Figure 4:
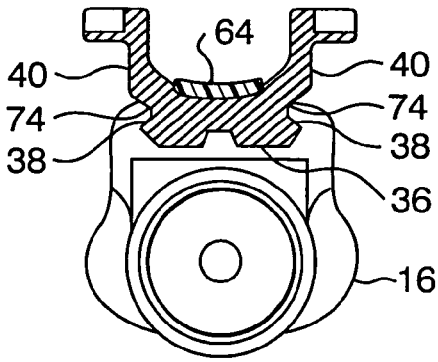
FIG. 4 is a cross-sectional view of the accessory mount shown in FIG. 3, taken along the line 4—4 of FIG. 3 and viewed in the direction of the appended arrows, FIG. 4 further including a front view representation of a light beam generator apparatus supportedly engaged by to the rail structure of the accessory mount.
Figure 3:
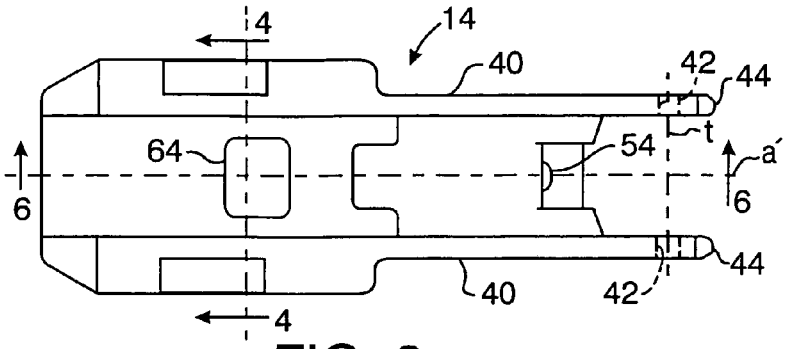
FIG. 3 is a top plan view of the accessory mount shown in FIGS. 1 and 2, in increased scale, but with the rear spring and trigger guard bumper removed for clarity of description.

After the accessory mount 14 has been installed on the handgun 12, an accessory such as a light beam generator apparatus may be mounted to the accessory mount 14. For example, as shown in FIGS. 1 and 4, the light module 16 includes a pair of longitudinal tongues 74 for slidably mating with the longitudinal grooves 38 of the accessory mount's rail 36. A latch on the light beam generator housing may co-act with a transverse slot 76 in the rail 36 for releasably preventing further longitudinal movement of the light beam generator 16 along the rail 36 when the light beam generator 16 is at a predetermined position along the rail 36. Light beam generators of this type are shown in the aforementioned U.S. Pat. No. 6,378,237 incorporated herein by reference.

Thus, there has been described a preferred embodiment of an accessory mount for removably mounting an accessory to a firearm. The accessory mount of the preferred embodiment is removably secured to the firearm through utilization of an improved slide stop and pin combination, in which the slide stop is pivotally secured to the pin. The accessory mount preferred embodiment is positionally stabilized with respect to the firearm by means of a shock-absorbing trigger guard bumper. Other embodiments of the present invention and of its various aspects, and variations of the embodiment and its aspects described herein, may be developed without departing from the essential characteristics thereof. Accordingly, the invention should be limited only by the scope of the claims listed below.

I claim:

1. An accessory mount for mounting an accessory device to a firearm, the firearm including a longitudinal barrel, a frame having a transverse bore and a trigger guard, the accessory mount comprising the combination of:

a longitudinal rail adapted for removably securing the accessory device thereto;

structural members upwardly projecting from the respective sides of said rail and adapted to straddle the frame with said rail beneath the barrel and forwardly of the trigger guard, said structural members including respective bores situated for being transversely aligned with the bore in the frame when the accessory mount is applied to the firearm;

a pin configured for being received by said bores in said structural members and the bore in the frame when the accessory mount is applied to the firearm;

an appendage downwardly projecting from said rail in the vicinity of the rear end of said rail; and a spring biased bumper carried by said appendage for being rearwardly urged against the trigger guard when the accessory mount is applied to the firearm with said pin received by said bores in said structural members and the bore in the frame.

2. The accessory mount according to claim 1, wherein:

said appendage includes a front wall depending from said rail; and said spring biased bumper includes a bumper and a spring secured between said bumper and said front wall.

3. The accessory mount according to claim 2, wherein:

said bumper comprises a resilient bumper.

4. The accessory mount according to claim 2, wherein:

said appendage includes lateral walls rearwardly extending from said front wall, said lateral walls adapted for straddling a front portion of the trigger guard when the accessory mount is applied to the firearm.

5. The accessory mount according to claim 1, including:

a spacer on said rail for engaging a lower surface of the frame of the firearm.

6. The accessory mount according to claim 5, wherein:

said spacer comprises a resilient pad.

7. The accessory mount according to claim 1, the firearm including a slide and a slide stop, wherein:

said pin is secured to the slide stop for pivotally securing the slide stop to the frame of the firearm.

8. The accessory mount according to claim 1, the firearm including a slide and a slide stop, wherein:

said pin is secured to the slide stop with the slide stop pivotable about said pin.

9. The accessory mount according to claim 1, the firearm including a slide and a slide stop, wherein:

the slide stop is rotatably secured to said pin.

10. An accessory mount for mounting an accessory device to a firearm, the firearm including a longitudinal barrel, a frame having a transverse bore, a slide movable along the frame, and a trigger guard, the accessory mount comprising the combination of:

a longitudinal rail adapted for removably securing the accessory device thereto;

structural members upwardly projecting from the respective sides of said rail and adapted to straddle the frame with said rail beneath the barrel and forwardly of the trigger guard, said structural members including respective bores situated for being transversely aligned with the bore in the frame when the accessory mount is applied to the firearm;

a pin configured for being received by said bores in said structural members and the bore in the frame when the accessory mount is applied to the firearm;

a slide stop secured to said pin;

an appendage downwardly projecting from said rail in the vicinity of the rear end of said rail; and a spring biased bumper carried by said appendage for being rearwardly urged against the trigger guard when the accessory mount is applied to the firearm with said pin received by said bores in said structural members and the bore in the frame.

11. The accessory mount according to claim 10, wherein:

said slide stop is pivotally secured about said pin.

12. The accessory mount according to claim 10, wherein:

said appendage includes a front wall depending from said rail; and said spring biased bumper includes a bumper and a spring secured between said bumper and said front wall.

13. The accessory mount according to claim 12, wherein:

said bumper comprises a resilient bumper.

14. The accessory mount according to claim 12, wherein:

said appendage includes lateral walls rearwardly extending from said front wall and straddling a front portion of the trigger guard when the accessory mount is applied to the firearm.

15. The accessory mount according to claim 10, including:

a spacer on said rail engaging a lower surface of said frame when the accessory mount is applied to the firearm.

16. The accessory mount according to claim 15, wherein:

said spacer comprises a resilient pad.

17. Firearm and accessory mount apparatus, comprising in combination:

a firearm including a longitudinal barrel, a frame having a transverse bore, a slide movable along said frame, and a trigger guard;

a longitudinal rail adapted for removably securing an accessory device thereto;

structural members upwardly projecting from the respective sides of said rail and straddling said frame with said rail beneath the barrel and forwardly of the trigger guard, said structural members including respective bores transversely aligned with said bore in said frame;

a pin received by said bores in said structural members and said bore in the frame;

a slide stop secured to said pin;

an appendage downwardly projecting from said rail in the vicinity of the rear end of said rail; and a spring biased bumper carried by said appendage and rearwardly urged against the trigger guard.

18. The apparatus according to claim 17, wherein:

said slide stop is pivotally secured about said pin.

19. The apparatus according to claim 17, wherein:

said appendage includes a front wall depending from said rail; and said spring biased bumper includes a bumper and a spring secured between said bumper and said front wall.

20. The apparatus mount according to claim 19, wherein:

said bumper comprises a resilient bumper.

21. The apparatus mount according to claim 19, wherein:

said appendage includes lateral walls rearwardly extending from said front wall and straddling a front portion of said trigger guard.

22. The apparatus mount according to claim 17, including:

a spacer on said rail engaging a lower surface of said frame.

23. The apparatus mount according to claim 22, wherein:

said spacer comprises a resilient pad.

24. An accessory mount for mounting an accessory device to a firearm, the firearm including a longitudinal barrel, a frame having a transverse bore, a slide movable along the frame, and a trigger guard, the accessory mount comprising the combination of:

a longitudinal rail adapted for removably securing the accessory device thereto;

structural members upwardly projecting from the respective sides of said rail and adapted to straddle the frame with said rail beneath the barrel and forwardly of the trigger guard, said structural members including respective bores situated for being transversely aligned with the bore in the frame when the accessory mount is applied to the firearm;

a pin configured for being received by said bores in said structural members and the bore in the frame when the accessory mount is applied to the firearm;

a slide stop pivotally secured to said pin;

an appendage downwardly projecting from said rail in the vicinity of the rear end of said rail; and a rearwardly biased bumper carried by said appendage for being rearwardly urged against the trigger guard when the accessory mount is applied to the firearm with said pin received by said bores in said structural members and the bore in the frame.

25. In a method for installing an accessory mount to a firearm, the steps comprising:

providing a firearm including a longitudinal barrel, a frame having a transverse bore and a slide movable along said frame:

providing a slide stop and a pin for said firearm, said slide stop pivotally secured to said pin;

providing an accessory mount including a longitudinal rail and structural members upwardly projecting from respective sides of said rail, said structural members including respective transversely aligned bores;

placing said accessory mount to said firearm with said bores in said structural members aligned with said transverse bore in said frame;

inserting said pin through the aligned bores in said structural members and said frame;

pivoting said slide stop about said pin; and securing said slide stop to the slide.

* * * * *